United States Patent [19]

Dunn

[11] 4,172,028

[45] Oct. 23, 1979

[54] FINE PARTICLE SEPARATION BY ELECTROSTATICALLY INDUCED OSCILLATION

[75] Inventor: John P. Dunn, Elmira, N.Y.

[73] Assignee: Electro-Power-Tech., Inc., Elmira, N.Y.

[21] Appl. No.: 947,088

[22] Filed: Sep. 29, 1978

[51] Int. Cl.[2] ..... B03C 7/02

[52] U.S. Cl. ..... 209/12; 209/127 R; 209/243; 209/359

[58] Field of Search ..... 209/1, 12, 127 R, 127 C, 209/128, 233, 243, 359, 130, 129, 131; 55/131, 151

[56] References Cited

U.S. PATENT DOCUMENTS

| | | | |
|---|---|---|---|
| 2,361,946 | 11/1944 | Johnson et al. | 209/127 C |
| 2,803,344 | 8/1957 | Morrison | 209/127 C |
| 3,635,340 | 1/1972 | Dunn | 209/130 |
| 4,071,169 | 1/1978 | Dunn | 222/76 |

FOREIGN PATENT DOCUMENTS

| | | | |
|---|---|---|---|
| 700976 | 1/1941 | Fed. Rep. of Germany | 209/127 C |
| 117731 | 7/1958 | U.S.S.R. | 209/127 R |
| 250784 | 1/1972 | U.S.S.R. | 209/129 |
| 486790 | 2/1976 | U.S.S.R. | 209/127 R |

*Primary Examiner*—Ralph J. Hill

*Attorney, Agent, or Firm*—Snider, Sterne & Saidman

[57] ABSTRACT

The classification of small particles is performed by utilizing the oscillation of particles as they pass through electric fields. The apparatus utilizes vertically spaced sieve electrodes which are at the same or at a different potential as a particle charging device. The particle charging device transfers particles to an attracting electrode at a point located directly opposite the particle transfer zone. In this manner, oscillating particles are dropped between two vertical sieves and classification is accomplished as the particles move to the screen by virtue of their oscillation.

10 Claims, 4 Drawing Figures

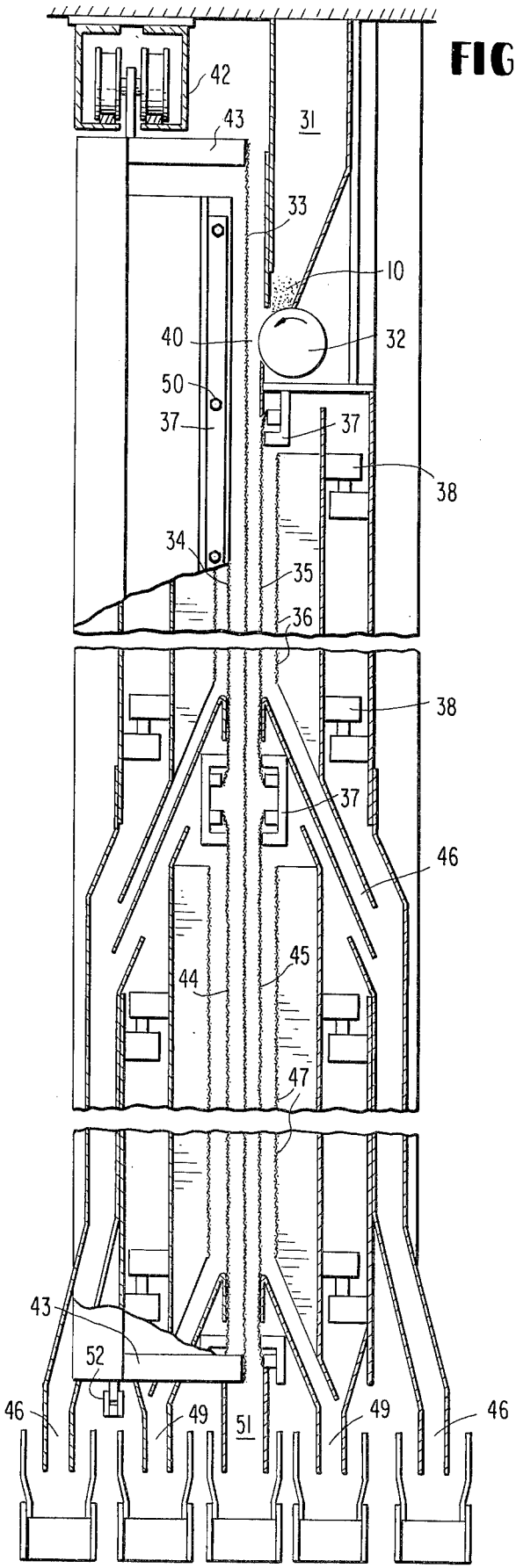
FIG. 3
FIG. 4
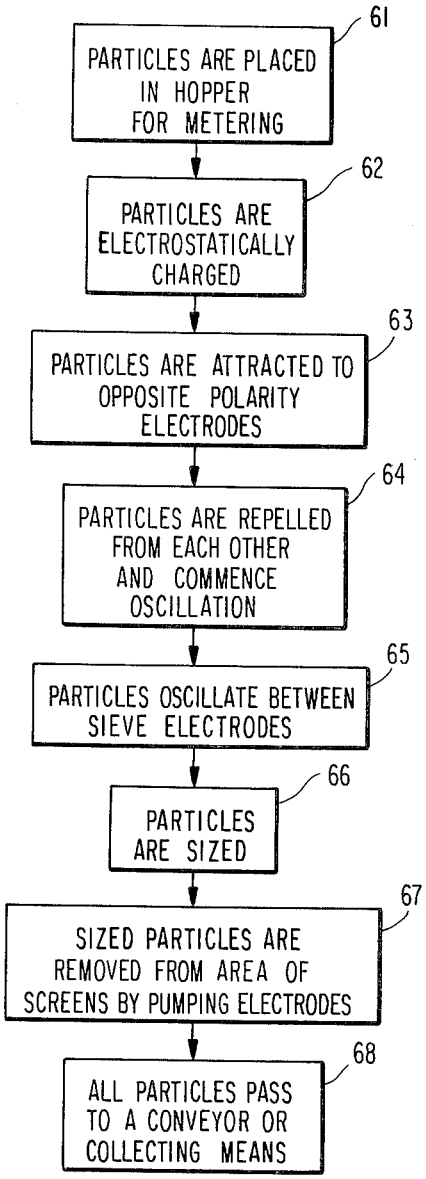

FINE PARTICLE SEPARATION BY ELECTROSTATICALLY INDUCED OSCILLATION

BACKGROUND OF THE INVENTION

The present invention is directed toward the apparatus and the method of separating fine particles which are capable of moving in an electrostatic field. The particles as they move through the electro-static field are caused to oscillate in response to the forces produced by the field. The oscillating particles are then separated or classified by passing them through classifying screens which are charged.

The concept of passing particles through an electrostatic field for the purpose of propelling the particles beyond a screen is disclosed in U.S. Pat. No. 3,635,340 to Dunn. This patent discloses the use of particle momentum produced by pulling the particles across a field to propel particles through a printing screen. Further, it is also disclosed that this propulsion of the particles beyond a second electrode may be used for possible particle classification. This patent, however, does not recognize or utilize particle oscillation as the vehicle for screen trials. It was further disclosed that particle separation could be accomplished by passing the particles across a horizontal conveying electrode which relied upon vibration to move the particles to the screen or stencil electrode mounted above the horizontal vibrating electrode.

Another example of the use of electrostatic separation of particles known in the prior art is shown in U.S. Pat. No. 2,361,946 to Johnson et al. The Johnson et al patent discloses an electrostatic separation of particles which utilizes direct fields or alternating fields for the production of particle dispersion, agitation and propulsion between electrodes. The Johnson et al patent utilizes an inclined electrode configuration where the sieve electrode is placed below an upper electrode. Where it is desired to use direct potentials, the upper electrode is a bare, solid, metallic electrode. A solid upper electrode has been found to be required in apparatus which use an inclined electrode configuration. The use of such electrodes, however, allows fine particles to adhere to the surface in local areas and thus produces variations in the electrical field strength, and sparking and possible stoppage of the process.

In the Johnson et al patent, the principle phenomena relied upon is the attraction and repulsion of particles between electrodes of an opposite charge. A particle by reason of the charge received from the lower sieving electrode is propelled upwardly to the upper electrode plate from which, by contact therewith, it receives the opposite charge and is propelled back down to the lower electrode. Particles which do not actually touch the upper electrode may also be propelled downwardly by gravity.

In the Johnson et al patent, there is no recognition of the potential use of the inherent oscillation of a dispersed group of particles between electrodes of a like charge.

The prior art has also utilized electrostatic fields for the separation of particles through the technique of passing the particle through a field and relying upon the mass-to-charge ratio to accomplish the separation. An example of this is found in U.S. Pat. No. 2,803,344 to Morrison, which utilizes gravity to separate the particles as they pass across an electrostatic field. This technique, however, does not rely upon the oscillating motion produced by the electrostatic dispersion to propel the particles to a classifying screen. In this apparatus, there is no requirement that the particles oscillate during separation since there is no classification screen against which trails are made.

SUMMARY OF THE INVENTION

This invention utilizes the oscillation which is produced in a powder which is acted upon by an electrostatic field. The passing of particles from one electrode toward a second of opposite polarity will place a charge on the particle which causes oscillation, dispersion and movement toward the second electrode. This invention utilizes the oscillation of the particles to produce motion relative to classification screens. The oscillation produces the necessary trials against the screens for classification.

It is believed that the desired particle oscillation which occurs in a dispersed particle group during and after passage through an electrostatic field occurs because of changes in particle polarity, changes in the applied field gradients and the actual physical deflection of the particles from the electrode sufaces. It is also believed that the particles which achieve a dipole charge by virtue of their placement in an electrostatic field produce oscillation and dispersion due to the charge imbalance within the particle cloud.

In order to accomplish the particle sieving or separation by means of the particle oscillation produced by an electrostatic field, it is also necessary to arrange the particle classification or separation screens vertically and to place the screens close together. By this placement of screens, the oscillating particles may filter down between two screens and produce many trails during their downward passage. Further, it is desirable to make the verticle drop of the screens large in order to accommodate as many particle trails as is possible.

As envisioned by this invention, the polarity of the screen located directly below the feeding means or particle introduction means will be of the same polarity. Those particles which come in contact with an attracting electrode will, of course, become charged to an opposite sign. Once the particles move beyond the attracting electrode to which the DC potential is applied, they then move vertically downward between the sieve electrodes. One of the sieve electrodes is at the same potential as the feeding means, and it is the particle oscillation and trials against the screens which produce the sieving action.

It is also envisioned that an additional open mesh dispersion electrode at a potential opposite from the sieving electrodes may be placed between the sieving electrodes in the path of the downward moving oscillating particles. By the use of this optional dispersion grid, it has been found that the efficiency of the particle separation may be improved. This improvement is due to increased particle dispersion and the number of trails at the screens during the downward movement.

The feed mechanism as envisioned in this invention may comprise a rotating drum or may be any other suitable means for providing a constant feed of electrostatically dispersed particles. U.S. Pat. No. 4,071,169 to Dunn illustrates another electrostatic feed device which may be used to supply dispersed oscillating particles to a sieve mechanism as envisioned in this invention.

The basic process as envisioned by this invention requires first that the powder be metered from a hopper into the electrical transfer position by gravity flow or by mechanical means. It has been found that, for sizes above 325 mesh, an electromechanical feeder can be used. Below 325 mesh, feeders with rotating electrodes have also been successfully used. The second step is the electrical charging by contact, by induction or by ion bombardment of various individual particles, agglomerates or clusters of particles. It has been found that below 325 mesh (45 micrometers), induced charging is the preferred method.

The third step is the transferring of the charged particles from the feeder to an attracting electrode by an applied DC electrical field between the two electrodes. Voltages of between 3 to 20,000 volts DC have been used, with field strenghts of 10 k.v. to 40 k.v. The fourth step is the dispersion and initial oscillation of charged-polarized particles while they are in transit between the electrodes.

The fifth step is the transferring of the ocillating dispersed particles from the region of the attracting electrode to the region of the vertically disposed sieving electrodes. The sixth step is the sorting according to the size of the particles by passage trials at the screens. The seventh step is the attraction of particles which have passed through the sieve to a pumping grid or electrode which has apertures between four and fifteen times larger than the sieve electrode. The eighth step is the collection of those particles which pass through the sieve electrode and the collection of those particles which continue to oscillate between the sieve electrodes until their exit into a second collection system by means of gravity.

It has also been found in some applications to be beneficial to vibrate the screen grids, the attracting electrode and the pumping grids in order to remove accumulations of material from them.

It has still further been found that it is desirable in some instances to utilize a dispersion grid located between the sieve grids and of opposite charge to the sieve grids. This dispersion grid aids in the continuing oscillation of the particles by the further introduction of an assisting electrostatic field in the region of the sieve electrodes themselves. It is, therefore, the prime object of this apparatus and process to utilize the oscillating characteristics of particles which have been passed through an electrostatic dispersion apparatus to produce trails at electrostatic screens for the purpose of classifying charged particles. It is the recognition of this phenomena and the application of this phenomena to the useful purpose of separating and classifying particles which has made this invention possible.

BRIEF DESCRIPTION OF THE DRAWINGS

FIG. 3 shows an embodiment of the invention which is a two-stage sieve employing both dispersion and pumping grids.

FIG. 4 shows in block diagram form the basic steps of the particle sizing by trails of a screen which are produced by oscillation of particles which are electrostatically charged.

DESCRIPTION OF THE PREFERRED EMBODIMENT

Figure 1:
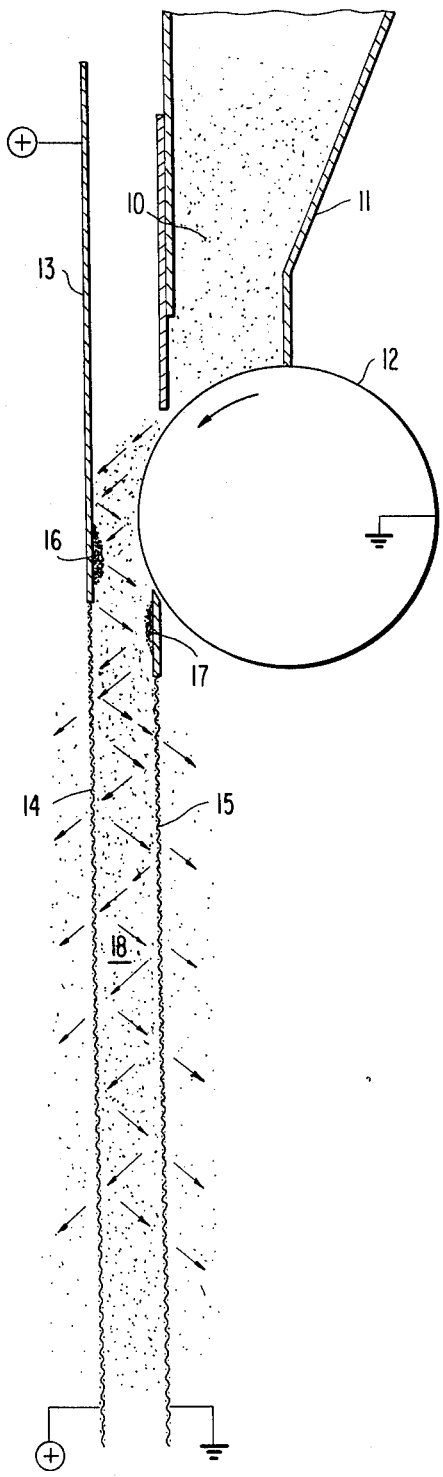
FIG. 1 shows the basic configuration with an attracting electrode and sieve electrode.

In the embodiment shown in FIG. 1, particles 10 are placed in hopper 11. The particles 10 are removed from the hopper 11 by means of a rotating drum 12. The rotating drum and hopper are at ground potential. Together, the hopper 11 and rotating drum 12 comprise a means for feeding electrostatically charged particles. This means for feeding the electrostatically charged particles may also be of other configurations, such as the electrostatic feeding device shown in U.S. Pat. No. 4,071,169.

As can be seen in FIG. 1, particles 10, upon being transferred to the surface of drum 12, are projected toward attracting plate 13 by means of the electrostatic field between drum 12 and plate 13. The electrostatic field between drum 12 and plate 13 is a direct field. As the particles move from drum 12 to plate 13, they undergo an accleration and a dispersion due to the repulsion among the particles, and they also commence to oscillate. The plate 13 is used as an attracting electrode, which attracts the particles from drum 12.

As the particles 10 hit the attracting electrode 13, they then bounce away and toward the region of screens 15 and 14. During this movement, the particles are continuing to disperse due to their opposite charges, and their oscillation is again maintained because of the imbalance in the space charge between electrodes. As the particles move downward, they begin to make repeated contact with the screens 14 and 15. It is due to this repeated contact which is caused by the oscillation that there are repeated trails of the particles against the holes or apertures in the screens 14 and 15. The screens 14 and 15 are arranged vertically, thereby permitting the cloud of oscillating particles 18 to move downwardly in response to the force of gravity.

The sieve electrode 15 is at the same potentials as drum 12, which is ground in FIG. 1. The polarity may also be reversed, and the drum 12 and screen 15 may be positive while the attracting electrode 13 becomes negative. It has been found that for finer particles it has been necessary to make the polarity of the rotating electrode negative or ground and the polarity of the attracting electrode 13 positive. This phenomenon is due to the electrical conductivity of the powder while it is on the feeder electrode.

The factors that may affect the processing of the particles are the surface and bulk conductivity of the particles, the electrode material, the thickness of the powder, the bulk density of the powder and whether the powder was compacted during the transfer from the hopper.

It has also been found that by periodic reversal of the polarity of the drum 12, and the attracting plate 13, as well as the sieve electrodes or screens 14 and 15, it is possible to induce charge on the surface of the powder which causes the removal of surface particles, such as clusters. In this reversal, the particles may transfer to the electric field due to being repelled from their adjacent neighbor when attracted to the opposite electrode.

In some instances, there has been a problem with an accumulation of fine material at the point where the particles strike the attracting electrode 13, and this is shown in FIG. 1 as accumulation 16. Further, as the particles move off of attracting electrode 13, they may also accumulate in the region of the top plate of the screen 15, which is depicted as reference numeral 17.

Figure 2:
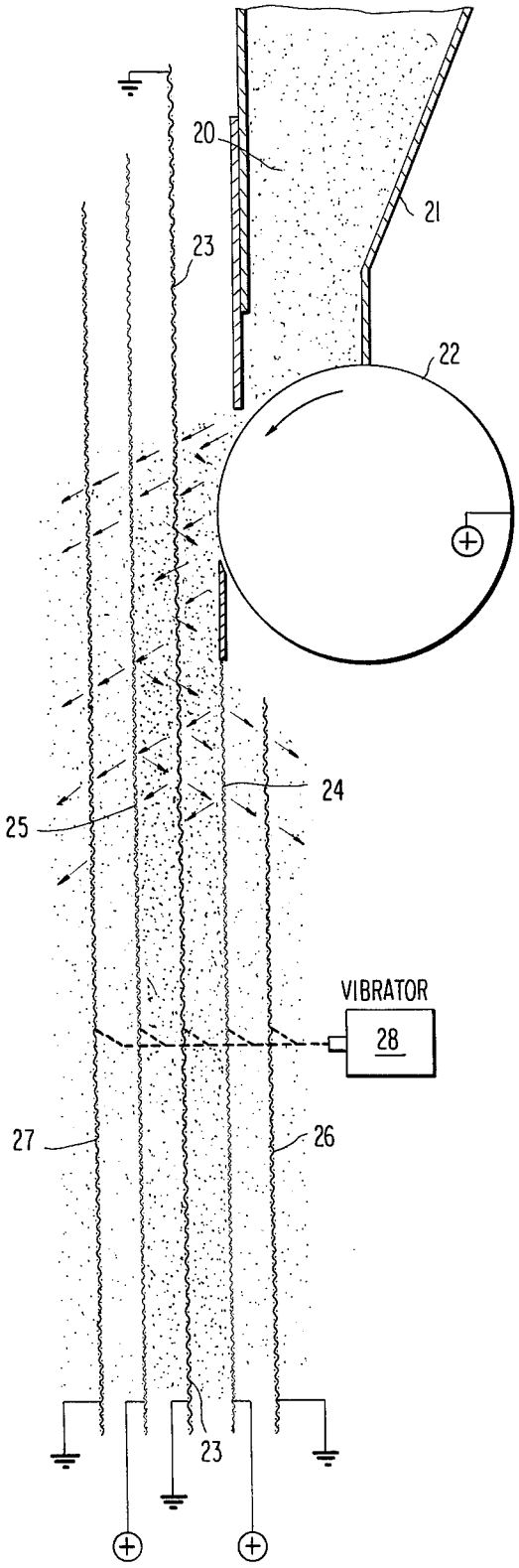
FIG. 2 shows a configuration which utilizes a dispersion grid and pumping grids.

These accumulations 16 and 17 are a gradual build up of fines on the solid electrode portions. This problem may be resolved by either placing the sieve electrode directly in front of the rotating electrode or by using a dispersion grid and sieve electrode combination as shown in FIG. 2.

The particles as they move between the sieve electrodes or screens 14 and 15 continue to oscillate in the region 18 so as to produce the necessary trials of the particles against the screens.

In FIG. 2, there is again shown a particle separation apparatus which utilizes the principles of this invention. The particles 20 are again fed through a hopper 21 into a rotating drum 22. The combination of the hopper 21 and rotating drum 22 comprises a means for feeding the particles into the electrostatic field. In this embodiment, there is a dispersion grid 23 which is placed immediately opposite the drum 22.

The dispersion grid 23 will have a mesh which is in the order ten times greater in size than the mesh of the sieve electrodes 24 and 25. The dispersing grid 23 in the region of the initial impact of the particles supplies the means for feeding particles and acts in a manner similar to the plate 13 of FIG. 1. The dispersion grid 23 may also act as an attracting electrode for production of the field which initially produces the dispersion and oscillation of the particles as they depart the drum 22.

The dispersion grid 23 in FIG. 2 is shown to have a potential at ground, and the drum 22 is shown to be at a positive potential. Again, the field between the drum 22 and the dispersion grid 23 is a direct field. It is also to be understood that the polarities of the drum 22 and the dispersion grid 23 may be reversed for certain forms of operation.

The attracting electrode can be either a dispersing grid such as 23, a solid electrode such as 13 depicted in FIG. 1 or even a sieve electrode or any combination thereof. What is required is that there be some form of electrode with a charge opposite that of the drum. The dispersing grid 23 will aid in deflocculating clusters of powder into primary particles. Further, placing an open grid structure between the electrical transfer point of the drum 22 and the sieve electrode will increase the time for the particles to disperse from each other before contact with the sieve electrodes. It is by changing the percent of the dispersion grid openings that the number of physical impacts against the dispersion grid are varied. The dispersion electrode assists in deflocculating the powder. The percentage opening is determined relative to the particle size or the size of the openings in the sieving electrodes.

Selection of a mesh size for the dispersion grid 23 is based upon the bond strength and the particle sizes of the powders to be separated. It has been found, for example, that separation of tungsten carbide powder at 26 micrometers requires that a dispersion grid ten times larger than the sieving mesh be used.

The apparatus of FIG. 2 also includes two additional electrodes which are pumping grid electrodes 26 and 27. These pumping grid electrodes also incorporate a mesh which is substantially larger than that of sieve electrodes. The purpose of the pumping electrodes is to draw the particles which have passed through the sieve electrodes and out into the region where they may fall to the bottom as fines and be collected. The pumping grids 26 and 27 are charged at a potential opposite that of the drum 22 and the sieving electrodes 24 and 25. The pumping electrodes serve to draw the particles away from the grids 24 and 25 since the pumping grids are charged opposite to the sieve electrodes or screens 24 and 25. Once the particles travel through the mesh of the pumping grid, they then are beyond any effect of electrostatic fields and are permitted to fall by gravity to the collection point. This pumping action is similar to that described in U.S. Pat. No. 3,635,340.

In the processing of certain fine particles, it may be necessary to rap or vibrate the sieve electrodes 24 and 25 and the dispersion grid 23. In some instances, it would be necessary even to provide a rapping or vibration to the pumping grids as well. In FIG. 2, there is shown schematically a vibrating or rapping means 28 which may be a solenoid or any other known vibrator with an appropriate frequency and aptitude which will cleanse the screens and grids attached thereto. Obviously, the means for attaching the vibrator 28 to the various grids must provide insulation from one grid to the next. It has also been found that, even in the absence of vibration and with the accumulation of fines on the electrodes, the process will continue, but less efficiently.

In FIG. 3, there is shown a two-stage sieving apparatus which incorporates this invention. In the apparatus of FIG. 3, there has again been incorporated both dispersion grids and pumping grids. In FIG. 3, the means for feeding again comprises a hopper 31 and a drum 32. The transfer point 40 is the point where the particles depart the drum and begin their oscillation and dispersion as they approach charged dispersion grid 33.

Since this is a two-stage device, there are two sets of sieving electrodes 34, 35 and 44, 45. The sieving electrodes are maintained in tension by means of adjusting screws 50. This embodiment also incorporates pumping grids 36 and 47 which pull the particles away from the region of the respective sieving electrodes prior to transfer to a collection point.

The sieve electrodes 34, 35 and 44, 45 are supported with a frame 37 which allows them to be maintained in tension and in position. By the use of such frames, the electrodes may be maintained in position even though they are subject to some force due to the electrostatic charges placed upon them and their close proximity to other oppositely charged electrodes.

The pumping grids 47 and 36 are provided with support brackets 38. In order to facilitate cleaning and maintenance of the sieving apparatus, there is provided a slide mechanism 42 at the top and a bottom guide 52 which allows the left-hand side, including dispersion grid 33, to roll in and out of the plane of FIG. 3 in order to expose the entire dispersion grid 33 and the face of sieving grids.

There is also provided a non-conducting support 43 for the dispersion grid 33.

Three sizes of particles are obtained from this apparatus. The finest particles 46 are obtained from the first set of sieves 35 and 35; the next finest particles 49 are obtained as a result of larger particles which are permitted to pass through the second stage sieving apparatus 44 and 45; and, finally, the coarse material 51 is obtained from the center section as it falls completely through without passing through any of the sieves.

All of the electrodes used in this apparatus are bare conducting materials and are not coated with dielectric materials. This is required because this apparatus is intended to operate with direct fields and direct current.

As can be seen from FIGS. 2 and 3, especially FIG. 3, this invention also contemplates a long vertical drop of the oscillating particles. This requires that the various sieve electrodes and dispersion grids also be placed vertically.

Also for proper operation, it is necessary to place the electrodes close together. The close spacing of the electrodes results in the oscillation and the electrical fields being the dominant force and not gravity. Gravity is, of course, utilized to move the dispersed particles through the sieving apparatus, but it is not used in the separation process. In this manner, the close spacing and the vertical drop of the oscillating dispersed particles produce the trails at the sieve electrodes necessary for the particle classification.

In summary, FIG. 4 shows the steps of the sieving process which utilizes electrostatically induced oscillation of particles as set forth hereinabove. The steps in the process as shown in FIG. 4 are 61—placing particles in a hopper for metering, 62—applying an electrostatic charge to the particles, 63—transferring the particles which are attracted to an opposite polarity electrode, 64—the repulsion of the particles from each other and the initiation of particle oscillation, 65—permitting the particles to oscillate between charged sieve electrodes, 66—sizing the particles as they pass through the sieve electrodes, 67—removal of the sized particles from the sieve electrodes or screens by use of pumping electrodes, and 68—collecting all of the particles for further use.

What is claimed is:

1. An apparatus for classifying by size fine particles comprising in combination:

(a) a source of direct potential having first and second terminals;

(b) means for feeding particles to a transfer point connected to said first terminal of said source of direct potential;

(c) an attracting electrode located opposite said transfer point and connected to said second terminal of said source of direct potential for causing said particles to disperse and to oscillate.

(d) closely spaced vertical sieve electrodes located below said transfer point and said attracting electrode which are connected to terminals of said source of direct potential for classifying according to size said particles; and (e) collection means located below said vertical sieve electrodes for receiving said particles, whereby said oscillating particles first pass next to said vertical sieve electrodes, and the smaller particles pass through the screens by use of the inter-particle oscillation which is induced in particles which have been subjected to direct electrostatic fields.

2. The apparatus of claim 1 wherein said attracting electrode is a bare solid conducting electrode.

3. The apparatus in claim 1 wherein said attracting electrode is a bare conducting mesh.

4. The apparatus of claims 1, 2 or 3 further comprising a dispersion grid having openings substantially greater than the openings in said sieve electrodes and extending between and parallel to the said vertical sieve electrodes, and connected to the second terminal of said source of direct potential.

5. The apparatus of claim 4 further comprising pumping grid electrodes which are placed parallel to said vertical sieve electrodes and on the side to which the fine particles pass, for pulling the particles that have passed through said sieve electrodes away from said sieve electrodes.

6. The apparatus of claim 1 wherein said means for feeding comprises a rotary drum and a hopper which feeds particles to said drum.

7. A process for separating fine particles according to size wherein said particles are responsive to a direct electrostatic field comprising the steps of:

(a) placing said particles to be classified into a hopper for supply to a means for feeding said particles;

(b) electrostatically charging said particles by the use of a direct field produced by connecting said first means for feeding to a source of direct potential and connecting the second terminal of said direct potential to an attracting electrode.

(c) transferring particles that have been electrically charged from said means for feeding the particles to said attracting electrode;

(d) causing said particles to disperse and to oscillate relative to each other;

(e) passing said particles between vertical sieve electrodes which are connected to the same potential as said means for feeding;

(f) passing those particles which are below a predetermined size through the mesh of said sieve electrodes; and (g) collecting the particles which have passed through and between the sieve electrodes.

8. The process of claim 7 further comprising the additional step of dispersing said particles as they pass between said vertical electrodes by means of vertical open mesh electrodes placed between said sieve electrodes.

9. The process of claims 7 or 8 further comprising the step of pumping said particles which have passed through said vertical sieve electrodes away from said vertical sieves.

10. The process of claim 9 further comprising the step of periodically revising the polarity of the terminals of said source of direct potential for cleaning the electrodes connected thereto.

* * * * *